US008797251B2

(12) United States Patent
Yang et al.

(10) Patent No.: US 8,797,251 B2
(45) Date of Patent: Aug. 5, 2014

(54) GATE DRIVING CIRCUIT AND DISPLAY DEVICE INCLUDING THE SAME

(75) Inventors: Jinwook Yang, Yongin (KR); Sang Jae Yeo, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 307 days.

(21) Appl. No.: 13/216,543

(22) Filed: Aug. 24, 2011

(65) Prior Publication Data

US 2012/0182050 A1 Jul. 19, 2012

(30) Foreign Application Priority Data

Jan. 13, 2011 (KR) ..... 10-2011-0003584

(51) Int. Cl.
*G09G 3/36* (2006.01)

(52) U.S. Cl.
USPC ..... 345/100

(58) Field of Classification Search
USPC ..... 345/173, 174, 175, 79, 80, 100, 204
See application file for complete search history.

(56) References Cited

U.S. PATENT DOCUMENTS

| | | | | |
|---|---|---|---|---|
| 7,486,268 | B2 * | 2/2009 | Jang et al. | 345/100 |
| 8,040,999 | B2 * | 10/2011 | Tobita | 377/64 |
| 8,134,529 | B2 * | 3/2012 | Kim et al. | 345/98 |
| 2008/0042950 | A1 * | 2/2008 | Park et al. | 345/87 |
| 2008/0074379 | A1 * | 3/2008 | Kim et al. | 345/99 |
| 2008/0238512 | A1 * | 10/2008 | Byeon | 327/199 |
| 2010/0039363 | A1 | 2/2010 | Lee et al. | |
| 2010/0053138 | A1 | 3/2010 | Im et al. | |

FOREIGN PATENT DOCUMENTS

| | | | |
|---|---|---|---|
| CN | 101650506 | A | 2/2010 |
| JP | 2010-061100 | A | 3/2010 |
| JP | 2010-061130 | A | 3/2010 |
| KR | 10-2008-0028079 | A | 3/2008 |
| KR | 10-2010-0021234 | A | 2/2010 |
| KR | 10-2010-0027878 | A | 3/2010 |

* cited by examiner

*Primary Examiner* — Dwayne Bost
*Assistant Examiner* — Robert Michaud
(74) *Attorney, Agent, or Firm* — Lee & Morse, P.C.

(57) ABSTRACT

Embodiments may be directed to a gate driving circuit. The gate driving circuit includes a pre-charge unit, a pull-up unit, a boosting unit, and a discharge unit. The pre-charge unit pre-charges a first node in response to a first input signal. The pull-up unit outputs a first clock signal as a gate driving signal in response to a first node signal of the first node. The boosting unit boosts the first node signal of the first node in response to the first node signal and the first clock signal. The discharge unit discharges the first node to a gate-off voltage level in response to a second input signal and a second clock signal.

19 Claims, 11 Drawing Sheets

GATE DRIVING CIRCUIT AND DISPLAY DEVICE INCLUDING THE SAME

CROSS-REFERENCE TO RELATED APPLICATIONS

This U.S. non-provisional patent application claims priority under 35 U.S.C. §119 of Korean Patent Application No. 10-2011-0003584, filed on Jan. 13, 2011, the entire contents of which are hereby incorporated by reference.

BACKGROUND

Embodiments relate to a display device.

As a type of user interface, mounting a display device on an electronic system is indispensable. Flat panel display devices are widely being used for their particular characteristics, i.e., light, thin, short, small and low power consumption. Flat panel display devices are categorized into Organic Light Emitting Diodes (OLEDs), Liquid Crystal Displays (LCDs), Field Emission Display (FEDs), Vacuum Fluorescent Displays (VFDs), and Plasma Display Panels (PDPs) based on the kinds of image display panels.

Such display devices include a display panel, and a driving circuit for driving the display panel. The driving circuit is configured with a gate driving circuit and a data driving circuit. The gate driving circuit includes a gate driving Integrated Circuit (IC). Recently, the gate driving IC is implemented with amorphous Silicon Thin Film Transistor (a-Si TFT).

SUMMARY

Embodiments may be directed to a gate driving circuit including: a pre-charge unit pre-charging a first node in response to a first input signal; a pull-up unit outputting a first clock signal as a gate driving signal in response to a first node signal of the first node; a boosting unit boosting the first node signal of the first node in response to the first node signal and the first clock signal; and a discharge unit discharging the first node to a gate-off voltage level in response to a second input signal and a second clock signal.

In some embodiments, the pre-charge unit may include a first transistor connected between a first voltage and the first node, and controlled by the first input signal.

In other embodiments, the pull-up unit may include a second transistor connected between the first clock signal and the gate driving signal, and controlled by the first node signal of the first node.

In still other embodiments, the boosting unit may include: a first capacitor connected between the first node and a second node; and a third transistor connected between the first clock signal and the second node and having a gate controlled by the first node signal of the first node.

In even other embodiments, the discharge unit may include a fourth transistor connected between the first node and a second voltage and controlled by a second input signal.

In yet other embodiments, the discharge unit may include: a fifth transistor connected between the second node and a gate-off voltage and having a gate controlled by the second clock signal; a second capacitor connected between the first clock signal and a third node; a sixth transistor connected between the second node and the gate-off voltage and having a gate controlled by a third node signal of the third node; a seventh transistor connected between the first node and the gate-off voltage and having a gate controlled by the third node signal of the third node; an eighth transistor connected between the third node and the gate-off voltage and having a gate controlled by the first node signal of the first node; a ninth transistor connected between a gate driving signal and the gate-off voltage and having a gate controlled by the third node signal of the third node; and a tenth transistor connected between the gate driving signal and the gate-off voltage and having a gate controlled by the second clock signal.

In further embodiments, each of the first and second clock signals may have a complementary level.

In still further embodiments, the gate driving circuit may further include a third capacitor connected between the second node and the gate-off voltage.

In even further embodiments, the discharge unit may further receive a third and a fourth clock signal, and the discharge unit may include: a fifth transistor connected between the second node and a gate-off voltage and having a gate controlled by the fourth clock signal; a second capacitor connected between the third clock signal and a third node; a sixth transistor connected between the second node and the gate-off voltage and having a gate controlled by a third node signal of the third node; a seventh transistor connected between the first node and the gate-off voltage and having a gate controlled by the third node signal of the third node; an eighth transistor connected between the third node and the gate-off voltage and having a gate controlled by the first node signal of the first node; a ninth transistor connected between a gate driving signal and the gate-off voltage and having a gate controlled by the third node signal of the third node; and a tenth transistor connected between the gate driving signal and the gate-off voltage and having a gate controlled by the second clock signal.

In yet further embodiments, frequencies of the first to fourth clock signals may be the same, the first and second clock signals may be complementary signals, the third and fourth clock signals may be complementary signals, the third clock signal may be shifted from a first level to a second level prior to the first clock signal, and the fourth clock signal may be shifted from the first level to the second level prior to the second clock signal.

In yet further embodiments, the discharge unit may further receive a third and a fourth clock signal, and the discharge unit may include: a third capacitor connected between the third clock signal and a fourth node; an eleventh transistor connected between the fourth node and the gate-off voltage and having a gate controlled by the first node signal of the first node; a twelfth transistor connected between the fourth node and the gate-off voltage and having a gate controlled by the fourth clock signal; and a thirteenth transistor connected between the second node and the gate-off voltage and having a gate controlled by a fourth node signal of the fourth node.

In still further embodiments, the first and second clock signals may be complementary signals having a same frequency, the third and fourth clock signals may be complementary signals having a same frequency, the frequency of the third and fourth clock signals may be twice as fast as that of the first and second clock signals, and the third clock signal may have a second level when the first and second clock signals have a first level.

In other embodiments, a display device may include: a plurality of stages which are dependently connected, wherein each of the stages includes: a pre-charge unit pre-charging a first node in response to a first input signal; a pull-up unit outputting a first clock signal as a gate driving signal in response to a first node signal of the first node; a boosting unit boosting the first node signal of the first node in response to the first node signal and the first clock signal; and a discharge unit discharging the first node to a gate-off voltage level in response to a second input signal and a second clock signal.

In some embodiments, the display device may further include: a timing controller generating the first and second clock signals; and a voltage generator generating a gate-off voltage.

In other embodiments, the pre-charge unit may include a first transistor connected between a first voltage and the first node and controlled by the first input signal.

In still other embodiments, the pull-up unit may include a second transistor connected between the first clock signal and the gate driving signal, and controlled by the signal of the first node.

In even other embodiments, the boosting unit may include: a first capacitor connected between the first node and a second node; and a third transistor connected between the first clock signal and the second node and having a gate controlled by the first node signal of the first node.

In yet other embodiments, the discharge unit may include a fourth transistor connected between the first node and a second voltage and controlled by a second input signal.

In further embodiments, the voltage generator may further generate the first and second voltages.

BRIEF DESCRIPTION OF THE DRAWINGS

The above and other features and advantages of present embodiments will become more apparent to those of ordinary skill in the art by describing in detail exemplary embodiments thereof with reference to the attached drawings in which.

DETAILED DESCRIPTION

Exemplary embodiments will now be described more fully hereinafter with reference to the accompanying drawings; however, they may be embodied in different forms and should not be construed as limited to the embodiments set forth herein.

Figure 1:
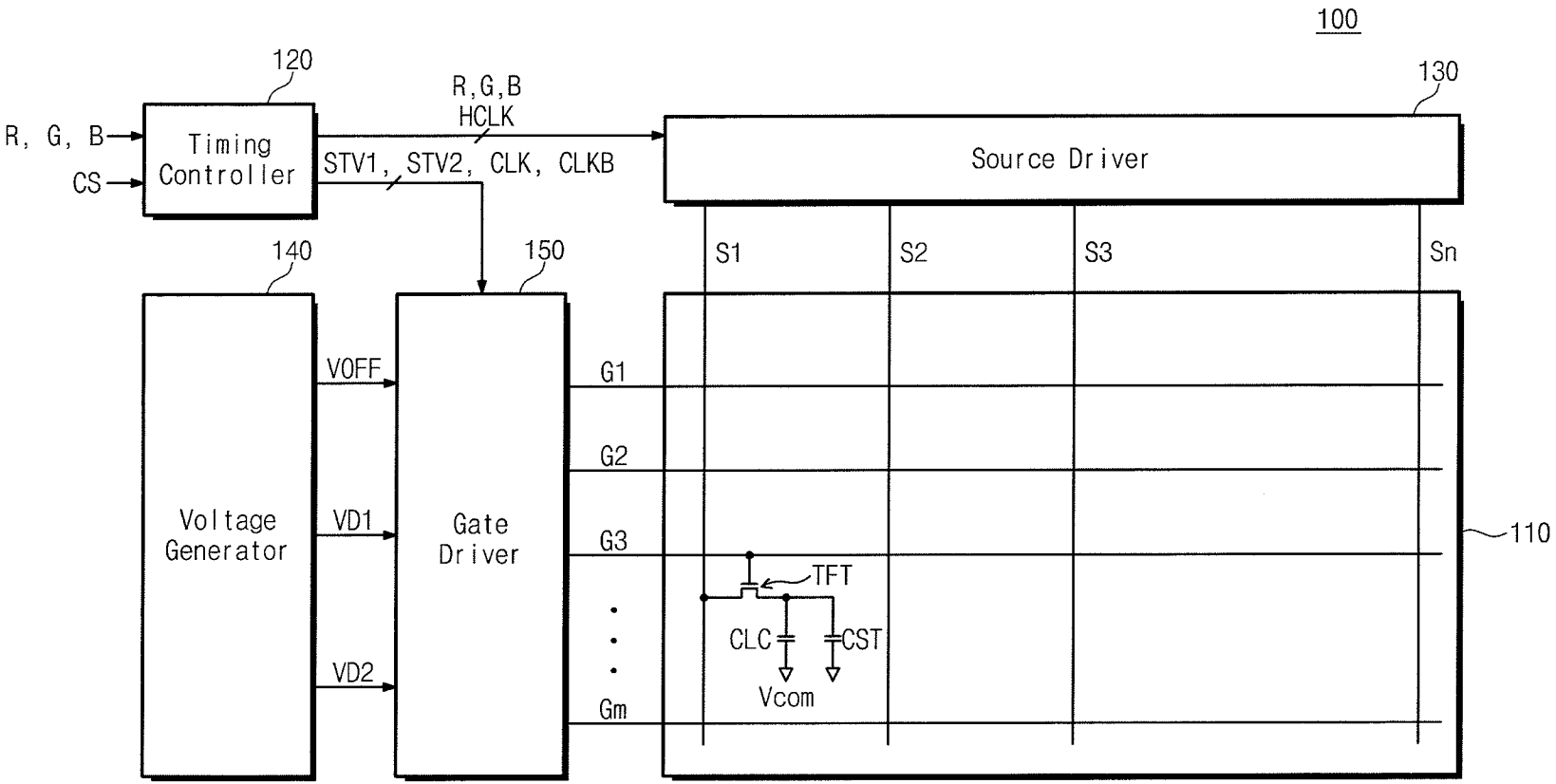
FIG. 1 is a block diagram illustrating a configuration of a Liquid Crystal Display (LCD) device according to an embodiment.

FIG. 1 is a block diagram illustrating a configuration of a Liquid Crystal Display (LCD) device according to an embodiment.

Referring to FIG. 1, an LCD device 100 according to an embodiment includes a liquid crystal panel 110, a timing controller 120, a source driver 130, a voltage generator 140, and a gate driver 150.

The liquid crystal panel 110 includes a plurality of gate lines, a plurality of source lines perpendicularly intersecting the gate lines, and a plurality of pixels that are respectively formed at intersection points of the gate lines and source lines. The pixels are arranged in a matrix type. Each of the pixels includes a thin film transistor TFT that has a gate electrode connected to a gate line and a source electrode connected to a source line, a liquid crystal capacitor CLC, and a storage capacitor CST, wherein one end of the liquid crystal capacitor is connected to a drain electrode of the thin film transistor TFT and one end of the storage capacitor CST is connected to the drain electrode of the thin film transistor TFT. Another end of the liquid crystal capacitor CLC and another end of the storage capacitor CST are connected to a common voltage VCOM. In such a pixel structure, the gate lines are sequentially selected by the gate driver 150, and when a pulse type of gate-on voltage is applied to the selected gate line, a thin film transistor of a pixel connected to the gate line is turned on, and then the source driver 130 applies a voltage including pixel information to each of the source lines. The voltage is applied to a liquid crystal capacitor and a storage capacitor through a thin film transistor of a corresponding pixel to drive the capacitors. Thus, a certain display operation is performed.

The timing controller 120 receives video data signals RGB and control signals CS from an external graphic source. The timing controller 120 outputs control signals (for example, a horizontal sync signal Hsync, a horizontal clock signal HCLK, vertical start signals STV1 and STV2, and first and second clock signals CLK and CLKB) necessary for driving the source driver 130 and the gate driver 150.

The source driver 130 receives image data signals RGB, the horizontal sync signal Hsync and the horizontal clock signal HCLK from the timing controller 120 to generate source driving signals S1 to Sm for driving the source lines of the liquid crystal panel 110.

The voltage generator 140 generates voltages VOFF, VD1 and VD2 necessary for driving of the gate driver 150. The voltage generator 140 may further generate voltages necessary for driving of the gate driver 150 and various voltages necessary for the operation of the display device 100.

The gate driver 150 outputs gate driving signals G1, G3, . . . , Gm−1 for sequentially driving the gate lines of the liquid crystal panel 110 according to the vertical start signals STV1 and STV2 and the first and second clock signals CLK and CLKB that are provided from the timing controller 120. Herein, scanning denotes that pixels connected to a gate line receiving the gate-on voltage are putted in a state where data may be written, by sequentially applying the gate-on voltage to the gate lines.

Figure 2:
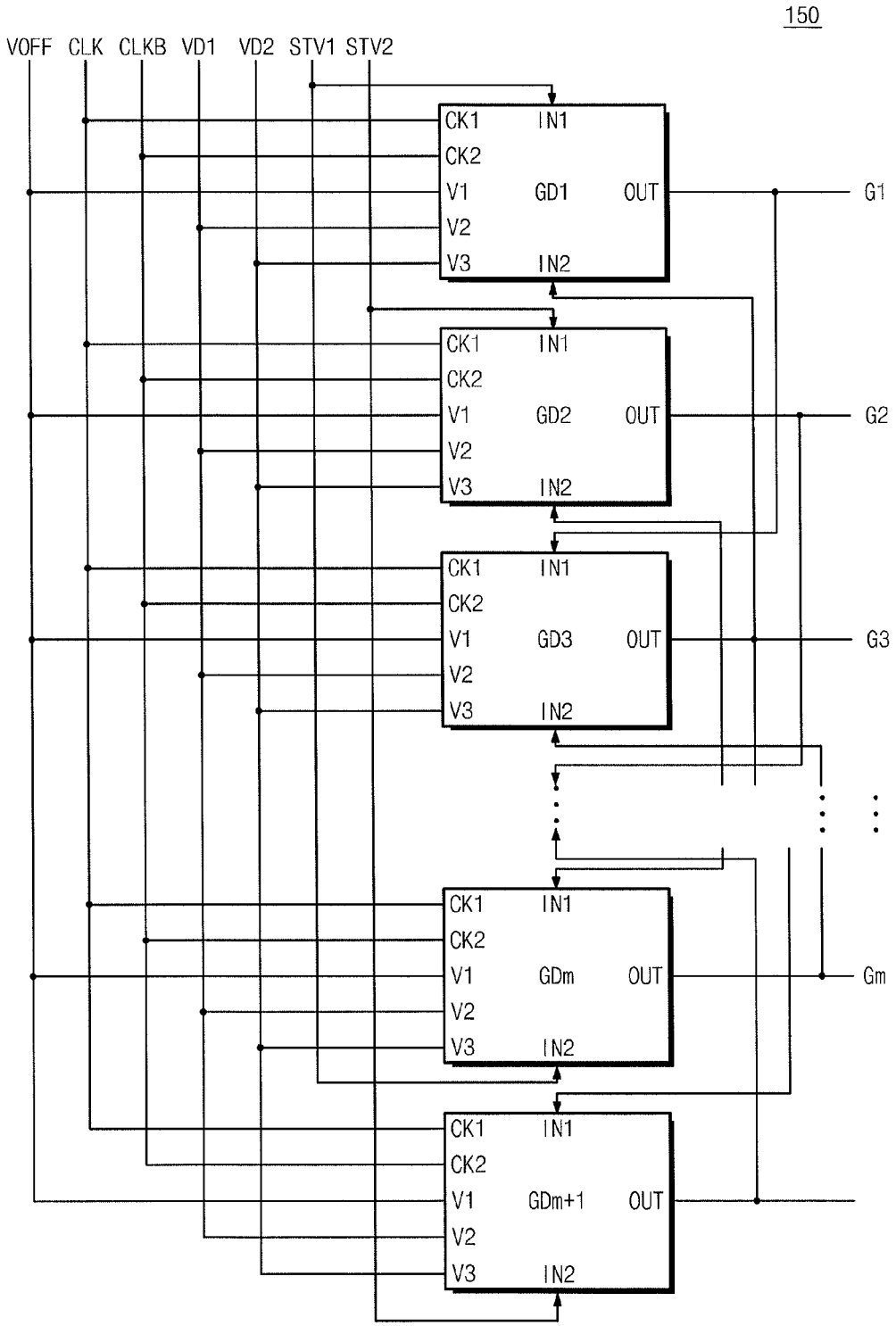
FIG. 2 is a diagram illustrating a detailed configuration of a gate driver of FIG. 1.

FIG. 2 is a diagram illustrating a detailed configuration of the gate driver of FIG. 1.

Referring to FIG. 2, the gate driver 150 includes a plurality of stages GD1 to GDm+1. The stages GD1 to GDm+1 are connected in a cascade structure, and the stages GD1 to GDm other than a final stage GDm+1 are connected to the gate lines in one-to-one correspondence relationship. Each of stages GD1 to GDm+1 has clock terminals CK1 and CK2, voltage terminals V1 to V3, initialization terminals IN1 and IN2 and an output terminal OUT, and receives the first and second clock signals CLK and CLKB, the gate-off voltage VOFF, the vertical start signals STV1 and STV2 and the driving voltages VD1 and VD2.

The initialization terminal IN1 of the first stage GD1 and the initialization terminal IN2 of the mth stage GDm receive the vertical start signal STV1 as a first input signal from the timing controller 120. The initialization terminal IN1 of the second stage GD2 and the initialization terminal IN2 of the m+1st stage GDm+1 receive the vertical start signal STV2 as a second input signal from the timing controller 120.

For example, the initialization terminal IN1 of the kth (k≠1) stage GDk receives the output of the k−2nd stage GDk−2, i.e., the gate driving signal Gk−2 as a first input signal. Furthermore, the initialization terminal IN2 of the kth (k≠1) stage GDk receives the output of the k+2nd stage GDk+2, i.e., the gate driving signal Gk+2 as a second input signal.

The stages GD1 to GDm output the gate driving signals G1 to Gm, respectively. At this point, when the first clock signal CLK has a high level, the odd-numbered stages GD1, GD3, . . . output the gate driving signals G1, G3, . . . , respectively. When the second clock signal CLKB has a high level, the even-numbered stages GD2, GD4, . . . output the gate driving signals G2, G4, . . . , respectively. Therefore, the stages GD1 to GDm may sequentially output the gate driving signals G1 to Gm.

Figure 3:
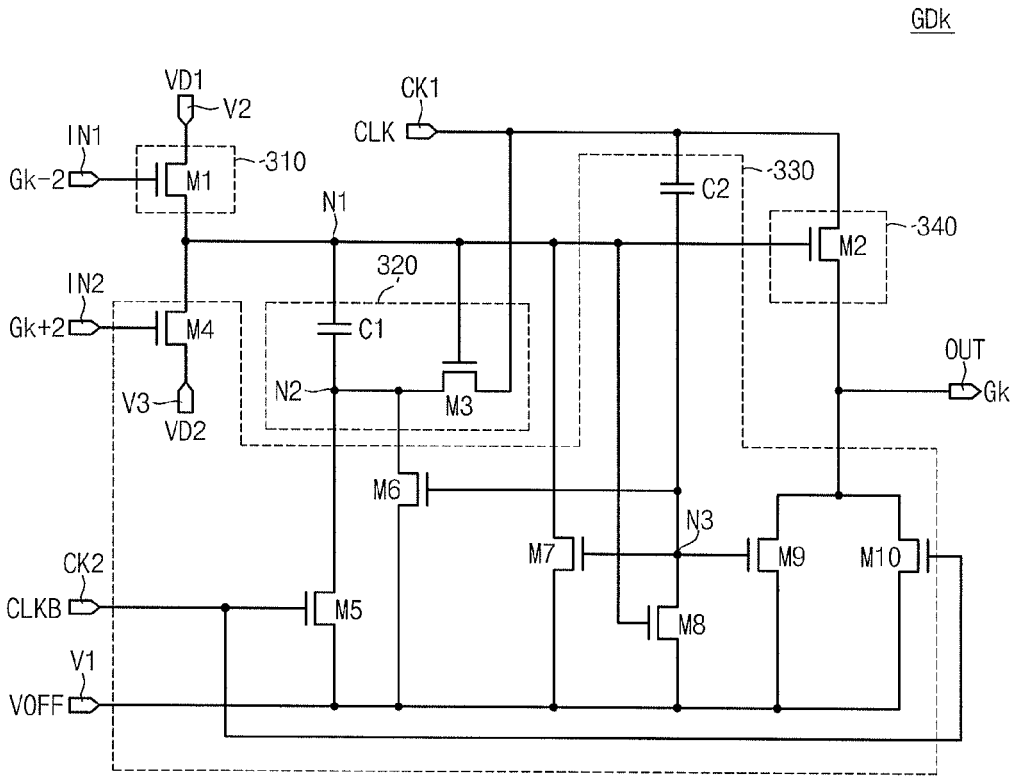
FIG. 3 is a circuit diagram illustrating a detailed configuration of a kth stage of FIG. 2.

FIG. 3 is a circuit diagram illustrating a detailed configuration of the kth stage of FIG. 2. In the specification, the detailed configuration of the kth stage GDk is illustrated and described, but the stages GD1 to GDm+1 have the same configuration as that of the kth stage GDk and operate similarly to the kth stage GDk.

Referring to FIG. 3, the stage GDk includes a pre-charge unit 310, a boosting unit 320, a discharge unit 330, and a pull-up unit 340. The pre-charge unit 310 pre-charges a first node N1 in response to the first input signal Gk−2. The pre-charge unit 310 includes a first transistor M1. The first transistor M1 is connected between the first node N1 and a voltage terminal receiving the first voltage VD1, and has a gate that is connected to an initialization terminal IN1 receiving the first input signal Gk−2.

The pull-up unit 340 outputs the first clock signal CLK as the gate driving signal Gk in response to signal of the first node N1. The pull-up unit 340 includes a second transistor M2. The second transistor M2 is connected between a clock terminal CK1 receiving the first clock signal CLK and an output terminal OUT to which the gate driving signal Gk is outputted, and has a gate connected to the first node N1.

The boosting unit 320 boosts the signal of the first node N1 in response to the first clock signal CLK and the signal of the first node N1. The boosting unit 320 includes a first capacitor C1 and a third transistor M3. The first capacitor C1 is connected between the first node N1 and a second node N2. The third transistor M3 is connected between the second node N2 and the clock terminal CK1 receiving the first clock signal CLK, and has a gate connected to the first node N1.

The discharge unit 330 discharges the first node N1 to a gate-off voltage VOFF level in response to the second input signal Gk+2 and the second clock signal CLKB. The discharge unit 330 includes a second capacitor C2, and third to tenth transistors M3 to M10. The fourth transistor M4 is connected between the first node N1 and a voltage terminal V3 receiving the second voltage VD2, and has a gate that is connected to the initialization terminal IN2 receiving the second input signal Gk+2. The fifth transistor M5 is connected between the second node N2 and a voltage terminal V1 receiving the gate-off voltage VOFF, and has a gate that is connected to the clock terminal CK2 receiving the second clock signal CLKB. Herein, the first and second clock signals CLK and CLKB have a complementary relationship.

The second capacitor C2 is connected between a third node N3 and the clock terminal CK1 receiving the first clock signal CLK. The sixth transistor M6 is connected between the second node N2 and the voltage terminal V1 receiving the gate-off voltage VOFF, and has a gate connected to the third node N3. The seventh transistor M7 is connected between the first node N1 and the voltage terminal V1 receiving the gate-off voltage VOFF, and has a gate connected to the third node N3. The eighth transistor M8 is connected between the third node N3 and the voltage terminal V1 receiving the gate-off voltage VOFF, and has a gate connected to the first node N1. The ninth transistor M9 is connected between the output terminal OUT outputting the gate driving signal Gk and the voltage terminal V1 receiving the gate-off voltage VOFF, and has a gate connected to the third node N3. The tenth transistor M10 is connected between the voltage terminal V1 receiving the gate-off voltage VOFF and the output terminal OUT outputting the gate driving signal Gk, and has a gate that is connected to a clock terminal CK2 receiving the second clock signal CLKB.

The operation of the kth stage GDk will be described below with reference to FIG. 4.

Figure 4:
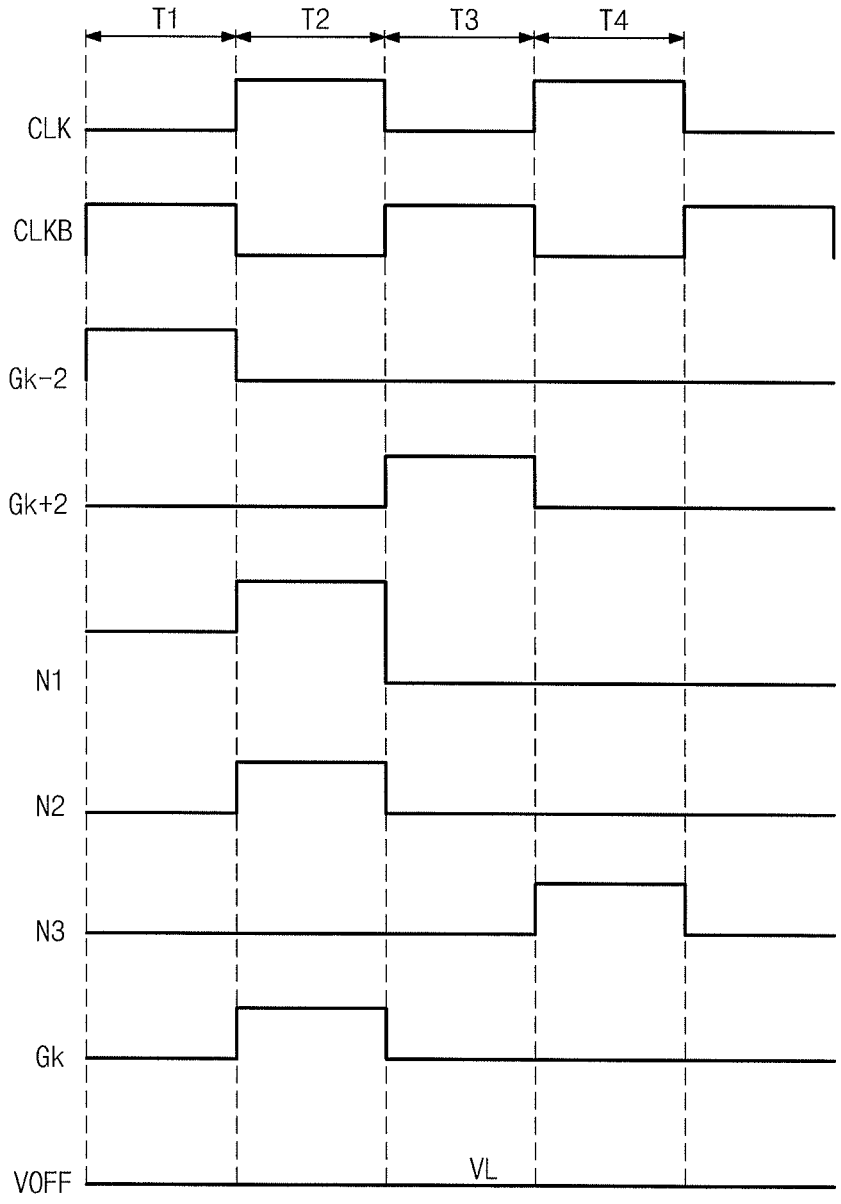
FIG. 4 is a timing diagram of signals which are used in the kth stage of FIG. 3.

FIG. 4 is a timing diagram of signals which are used in the kth stage GDk of FIG. 3.

Referring to FIGS. 3 and 4, in a first section T1, when the first input signal Gk−2 is activated to a high level, the signal of the first node N1 increases to a first voltage VD1 level that is inputted through the voltage terminal V2. Although the signal of the first node N1 increases by the first voltage VD1, since the first clock signal CLK has a low level, the gate line Gk has a low level even when the second transistor M2 is turned on. At this point, since the second clock signal CLKB has a high level, the fifth transistor M5 is turned on, and thus, the second node N2 is set to a gate-off voltage VOFF level and the first node N1 is maintained at a first voltage VD1 level by the capacitor C1. Moreover, since the second clock signal CLKB has a high level, the tenth transistor M10 is turned on, and thus, the gate driving signal Gk is maintained at the gate-off voltage VOFF level. Since the first node N1 has the first voltage VD1 level, the third transistor M3 is turned on.

In a second section T2, as the first input signal Gk−2 is deactivated to a low level, the first node N1 is floated. As the first clock signal CLK is shifted to a high level, the second node N2 increases to a high level through the third transistor M3. When the second node N2 increases to a high level (H), the voltage of the first node N1 is boosted to a level (for example, 2H) higher than the first voltage VD1 level by the first capacitor C1. At this point, since the first clock signal CLK has a high level, the second transistor M2 is turned on, and the gate driving signal Gk having a high level is outputted. In the second section T2, since the second clock signal CLKB has a low level, the fifth transistor M5 and the tenth transistor M10 are turned off.

In a third section T3, when the second input signal Gk+2 is shifted to a high level, the first node N1 is discharged to a second voltage VD2 level by the fourth transistor M4. Moreover, as the first clock signal CLK is shifted to a low level and the first node N1 is discharged, the third and sixth to ninth transistors M3 and M6 to M9 are turned off. In the third section T3, since the second clock signal CLKB has a high level, the tenth transistor M10 is turned on, and thus, the gate driving signal Gk is maintained at the gate-off voltage VOFF level.

In a fourth section T4, when the first clock signal CLK is shifted to a high level, since the third node N3 increases to a high level, the sixth, seventh and ninth transistors M6, M7 and M9 are turned on. Thus, the first node N1 and the gate driving signal Gk are maintained at the gate-off voltage VOFF level.

When the first clock signal CLK is shifted from a low level to a high level, although the second transistor M2 maintains a turn-off state, a coupling voltage may be applied to the first node N1 by a parasitic capacitance of the second transistor M2. In this case, a coupling voltage Vc due to the parasitic capacitance is expressed as Equation (1) below.

$$Vc=Cgs/(cl+Cgd+Dgs)*VCLK \quad (1)$$

where Cgs is a gate-source capacitance of the second transistor M2, cl is a capacitance of the first capacitor C1, Cgd is a gate-drain capacitance of the second transistor M2, and VCLK is a voltage level of a clock signal.

Herein, since cl>>Cgs=Cgd, the level of the coupling voltage Vc is very low and thus is not largely affected by coupling.

In this way, the gate driving circuit 150 maintains the first and second nodes N1 and N2, which are connected to the first capacitor C1 for boosting, at the gate-off voltage VOFF level when the gate driving signal Gk is driven to the gate-off voltage VOFF, and thus prevents the second transistor M2 from being abnormally turned on by an ambient environment.

Figure 5:
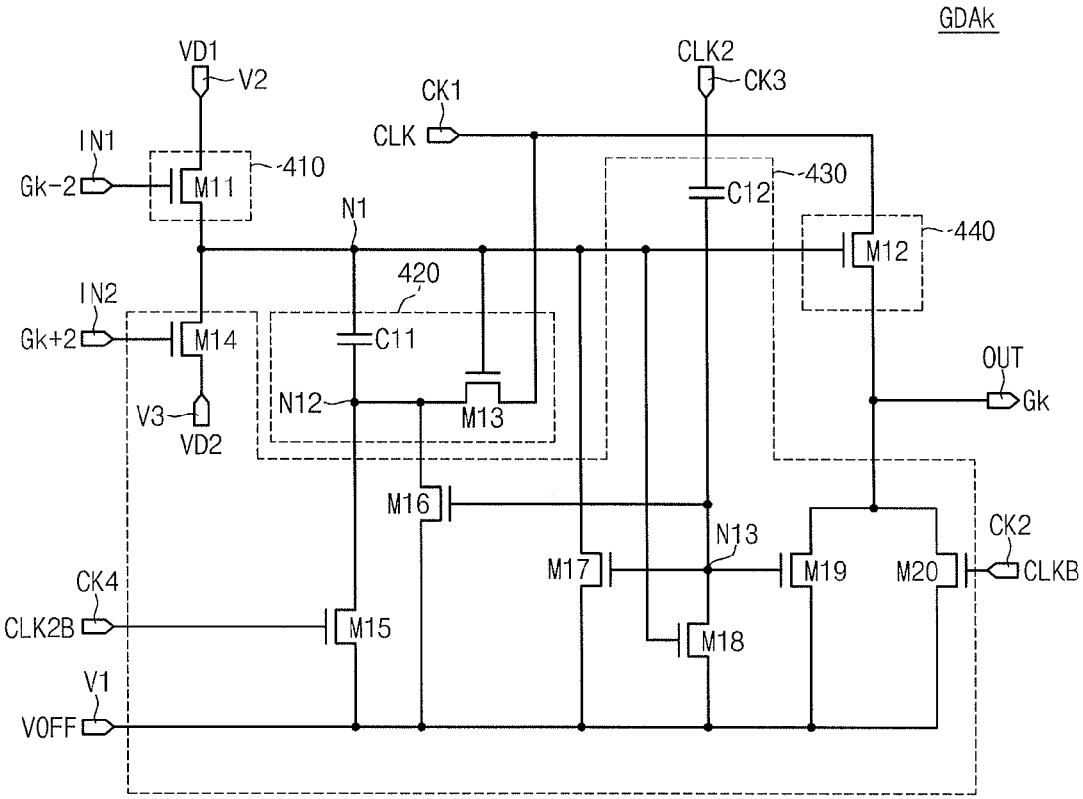
FIG. 5 is a circuit diagram illustrating a detailed configuration of a kth stage according to another embodiment.

The stage GDk of FIG. 3 may be good when a parasitic capacitance of the second transistor M2 is low or Cgs<<Cgd. FIG. 5 illustrates another embodiment for maintaining the first node N1 at the gate-off voltage VOFF level.

FIG. 5 is a circuit diagram illustrating a detailed configuration of a kth stage according to another embodiment. In the specification, the detailed configuration of a kth stage GDAk is illustrated and described, but stages GDA1 to GDAm+1 have the same configuration as that of the kth stage GDAk and operate similarly to the kth stage GDAk.

Referring to FIG. 5, the stage GDAk includes a pre-charge unit 410, a boosting unit 420, a discharge unit 430, and a pull-up unit 440. The stage GDAk of FIG. 5 has a circuit configuration similar to that of the stage GDk of FIG. 3, or further includes two clock terminals CK3 and CK4 unlike the stage GDk. A capacitor C12 is connected between a third node N13 and a third clock signal CLK2 inputted from the clock terminal CK3. Also, a fifth transistor M5 is controlled by a fourth clock signal CLK2B inputted from the clock terminal CK4.

Figure 6:
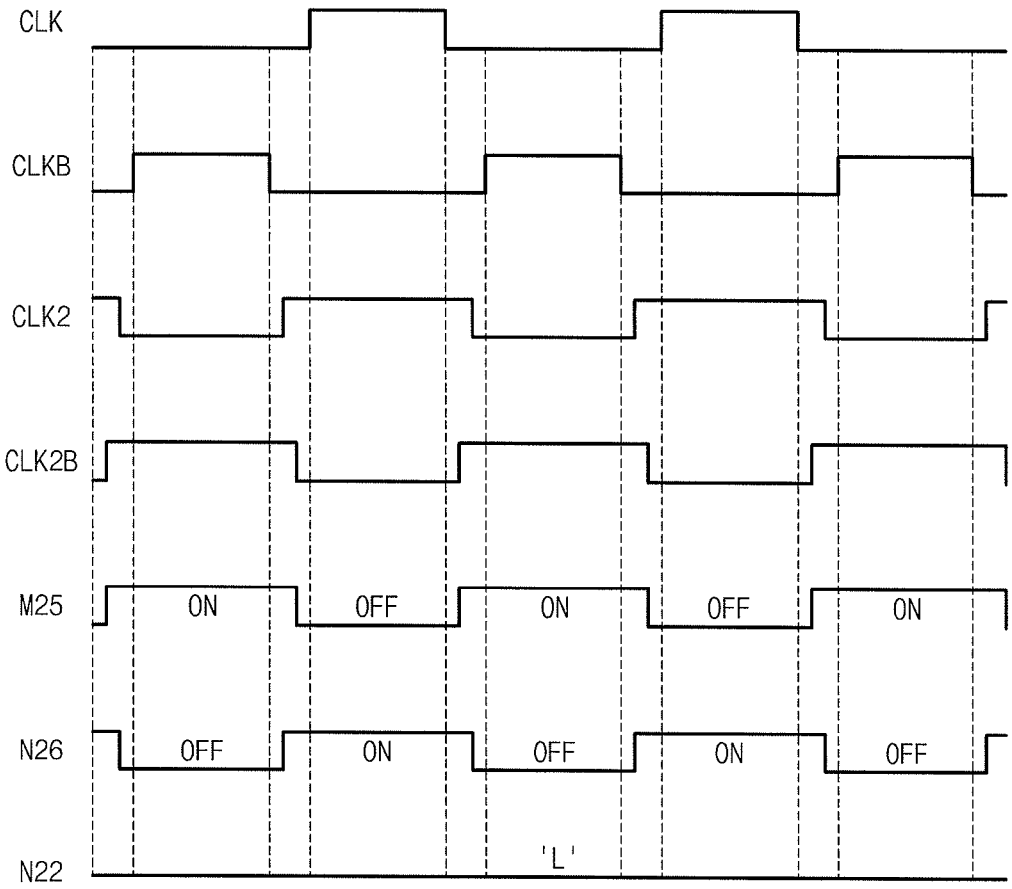
FIG. 6 is a timing diagram showing some signals which are used in an operation of the stage of FIG. 5.

FIG. 6 is a timing diagram showing some of signals which are used in an operation of the stage of FIG. 5.

Referring to FIGS. 5 and 6, the frequencies of first to fourth clock signals CLK, CLKB, CLK2 and CLK2B are the same, the first and second clock signals CLK and CLKB are complementary signals having different duty ratios, and the third and fourth clock signals CLK2 and CLK2B are complementary signals having different duty ratios. The third clock signal CLK2 is one that has a high-level section longer than that of the first clock signal CLK. The third clock signal CLK2 is shifted from a low level to a high level prior to the first clock signal CLK.

The third transistor M13 is turned on by the fourth clock signal CLK2B before the first clock signal CLK is shifted from a low level to a high level, and thus, a second node N12 is set to the gate-off voltage VOFF level. Since the capacitance of a capacitor C11 is very greater than a parasitic capacitance, the voltage level of a first node N11 can be prevented from increasing by the parasitic capacitance of a second transistor M12.

Figure 7:
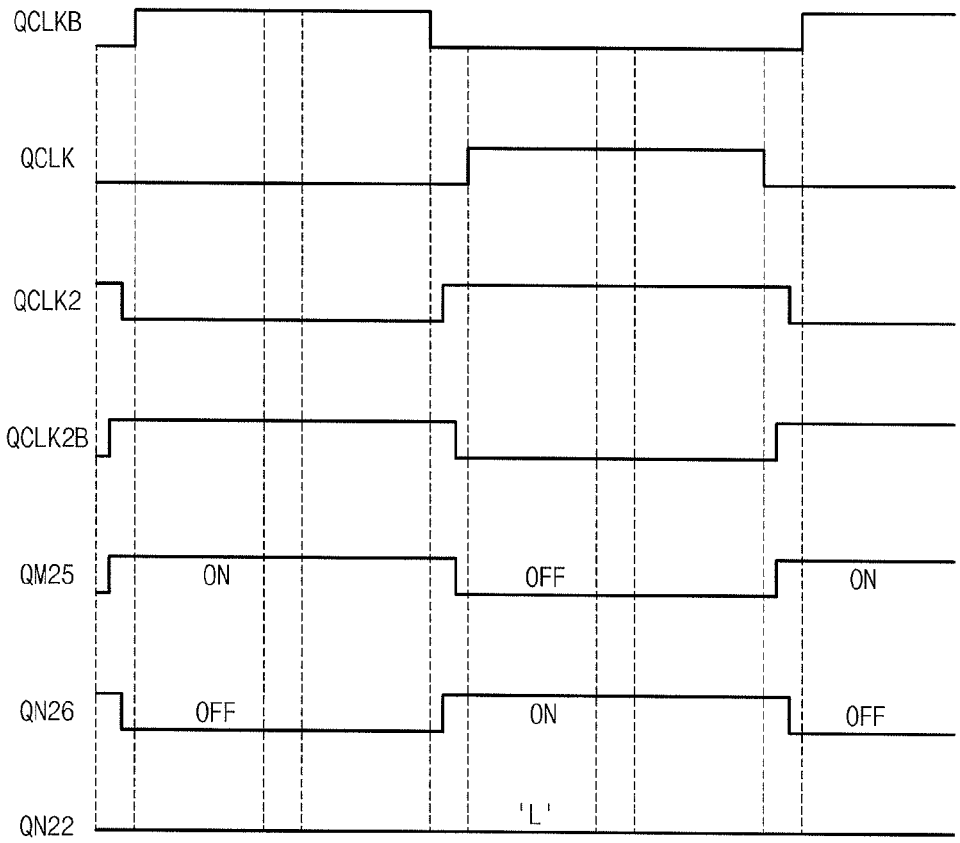
FIG. 7 is a timing diagram showing some signals which are used in an operation of the stage of FIG. 5 when a gate driver has a quadraple structure.

FIG. 7 is a timing diagram showing some of signals which are used in an operation of the stage of FIG. 5 when a gate driver has a quadraple structure.

The pulse widths of first to fourth clock signals QCLK, QCLKB, QCLK2 and QCLK2B in FIG. 7 are twice greater than the first to fourth clock signals CLK, CLKB, CLK2 and CLK2B that are used in the stage GDAk of FIG. 5.

Using the first to fourth clock signals QCLK, QCLKB, QCLK2 and QCLK2B, another embodiment may also be applied to a stage in a gate driver of a quadraple structure.

Figure 8:
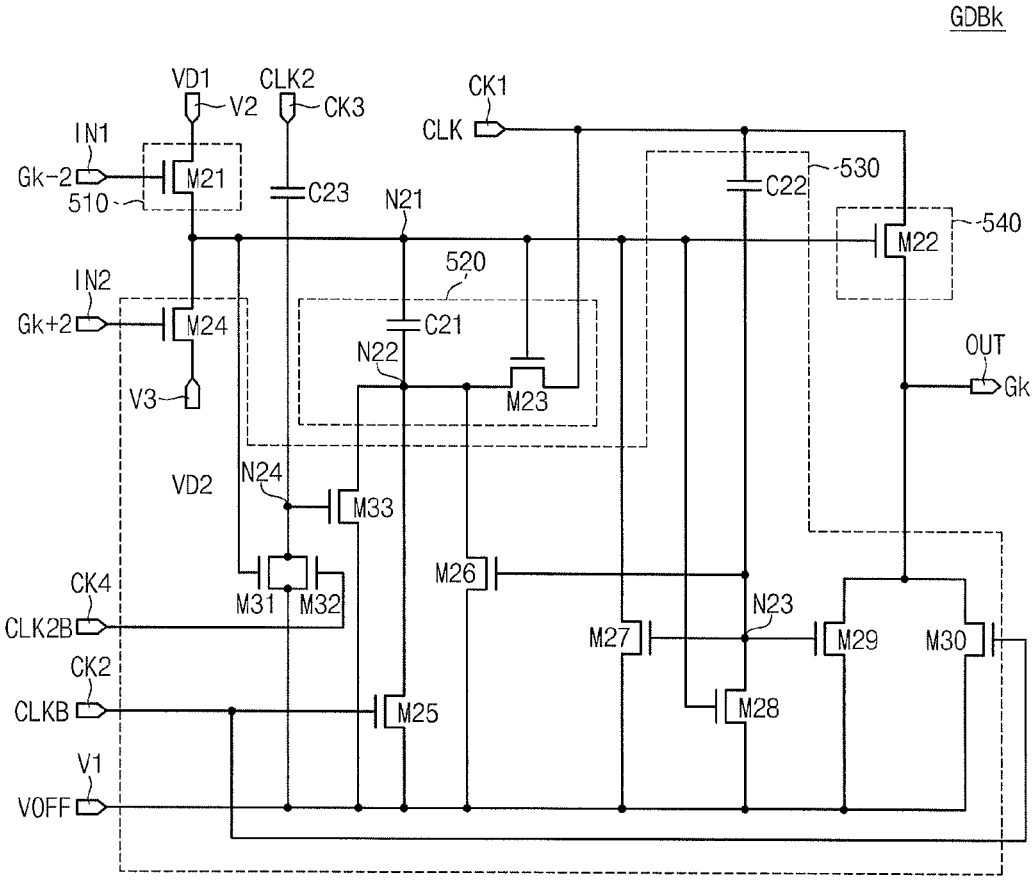
FIG. 8 is a circuit diagram illustrating a detailed configuration of a kth stage according to another embodiment.

FIG. 8 is a circuit diagram illustrating a detailed configuration of a kth stage according to another embodiment. In the specification, the detailed configuration of a kth stage GDBk is illustrated and described, but stages GDB1 to GDBm+1 have the same configuration as that of the kth stage GDBk and operate similarly to the kth stage GDBk.

Referring to FIG. 8, the stage GDBk includes a pre-charge unit 510, a boosting unit 520, a discharge unit 530, and a pull-up unit 540. The stage GDBk of FIG. 8 has a circuit configuration similar to that of the stage GDk of FIG. 3, or further includes two clock terminals CK3 and CK4 unlike the stage GDk. The discharge unit 530 further includes eleventh to thirteenth transistors M31 to M33, and a capacitor C23.

A third clock signal CLK2 is inputted to a clock terminal CK3, and a fourth clock signal CLK2B is inputted to a clock terminal CK4. The capacitor C23 is connected between the clock terminal CK3 and a fourth node N24. The eleventh transistor M31 is connected between the fourth node N24 and a voltage terminal V1 receiving a gate-off voltage VOFF, and has a gate connected to a first node N21. The twelfth transistor M32 is connected between the fourth node N24 and the voltage terminal V1 receiving the gate-off voltage VOFF, and has a gate connected to the first node N21. The thirteenth transistor M33 is connected between a second node N22 and the voltage terminal V1 receiving the gate-off voltage VOFF, and has a gate that is connected to a clock terminal CK2 receiving the second clock signal CLKB.

Figure 9:
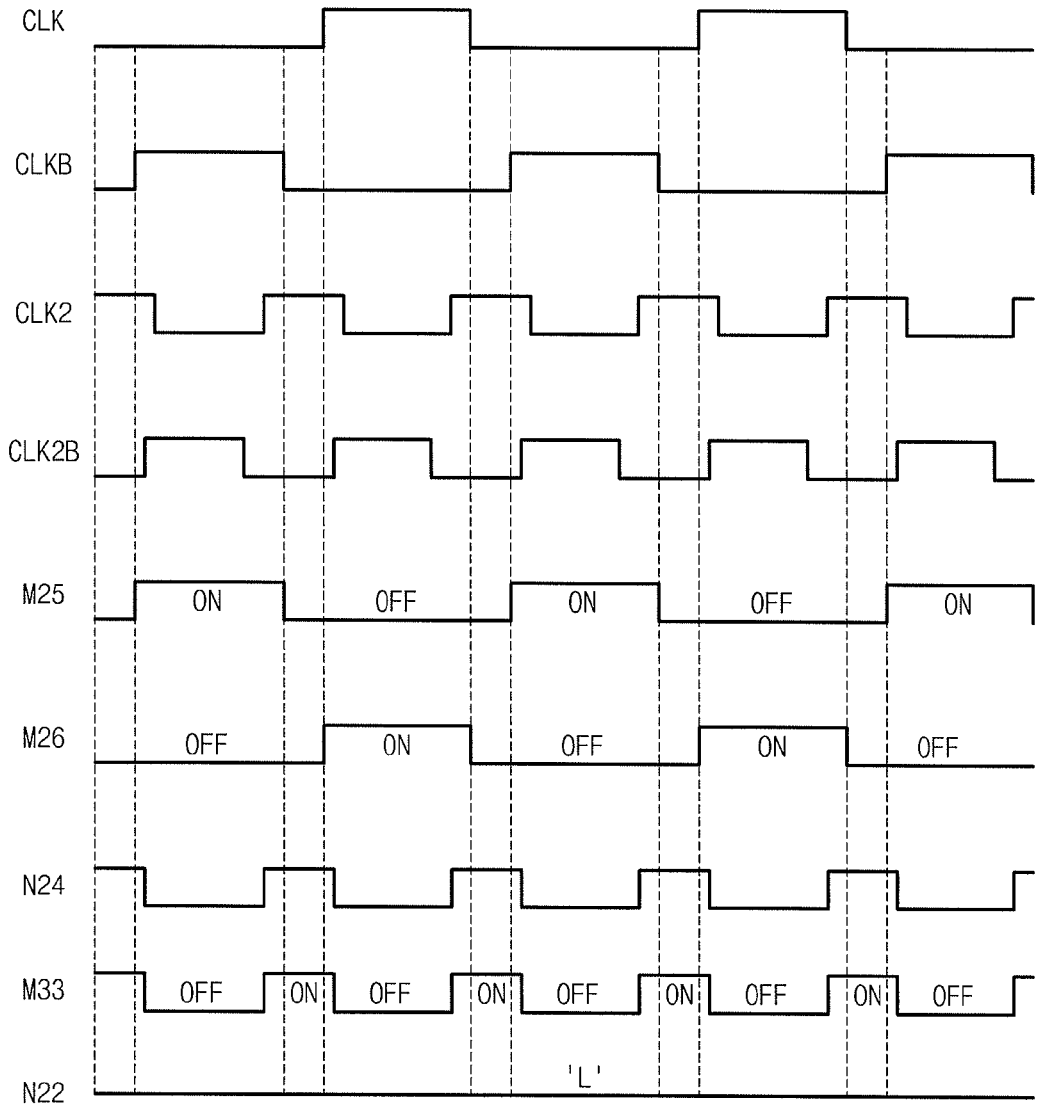
FIG. 9 is a timing diagram showing some signals which are used in an operation of the stage of FIG. 8.

FIG. 9 is a timing diagram showing some of signals which are used in an operation of the stage of FIG. 8.

Referring to FIGS. 8 and 9, the first and second clock signals CLK and CLKB are complementary signals having different duty ratios, and third and fourth clock signals CLK2 and CLK2B are complementary signals having different duty ratios. The third clock signal CLK2 has a cycle twice faster than that of the first clock signal CLK.

Except for a section (see T1 and T4 of FIG. 4) where the first node N21 is charged or boosted, the thirteenth transistor M33 is turned on in a section where fifth and sixth transistors M25 and M26 are turned off, and thus, the second node N22 is set to a gate-off voltage VOFF level. Since the capacitance of a capacitor C21 is very greater than a parasitic capacitance, the voltage level of the first node N21 can be prevented from increasing by the parasitic capacitance of a second transistor M22.

Figure 10:
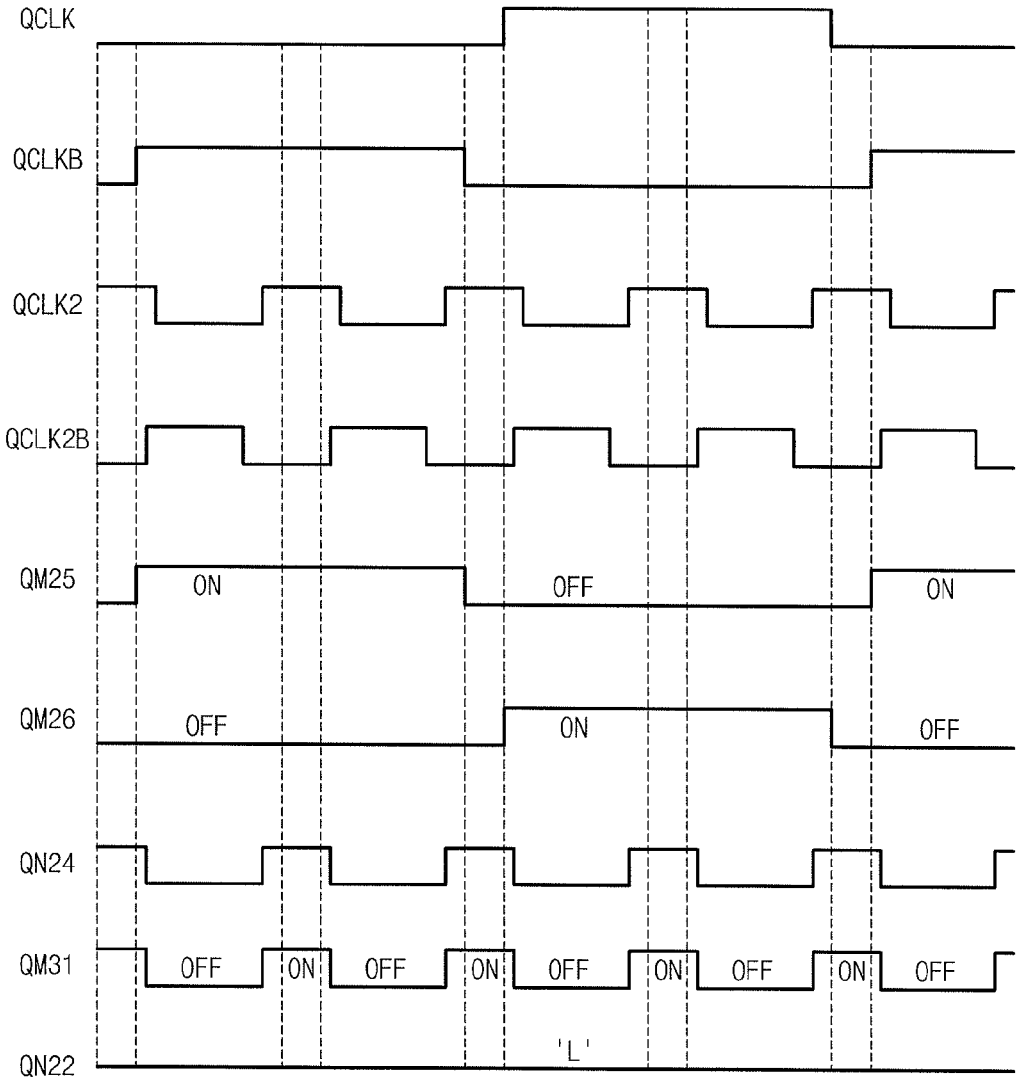
FIG. 10 is a timing diagram showing some signals which are used in an operation of the stage of FIG. 9 when a gate driver has a quadraple structure.

FIG. 10 is a timing diagram showing some of signals which are used in an operation of the stage of FIG. 9 when a gate driver has a quadraple structure.

The pulse widths of first to fourth clock signals QCLK, QCLKB, QCLK2 and QCLK2B in FIG. 10 are twice greater than the first to fourth clock signals CLK, CLKB, CLK2 and CLK2B that are used in the stage GDBk of FIG. 9.

Using the first to fourth clock signals QCLK, QCLKB, QCLK2 and QCLK2B, another embodiment may also be applied to a stage in a gate driver of a quadraple structure.

Figure 11:
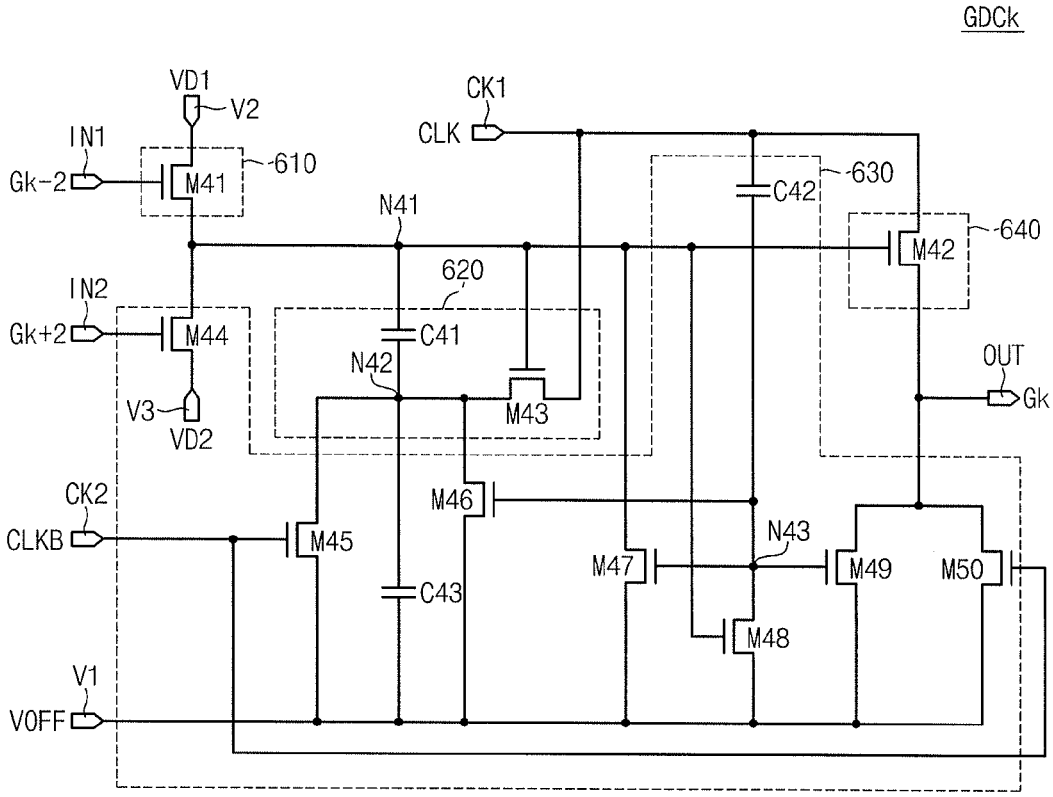
FIG. 11 is a circuit diagram illustrating a detailed configuration of a kth stage according to another embodiment.

FIG. 11 is a circuit diagram illustrating a detailed configuration of a kth stage according to another embodiment. In the specification, the detailed configuration of a kth stage GDCk is illustrated and described, but stages GDC1 to GDCm+1 have the same configuration as that of the kth stage GDCk and operate similarly to the kth stage GDCk.

Referring to FIG. 11, the stage GDCk includes a pre-charge unit 610, a boosting unit 620, a discharge unit 630, and a pull-up unit 640. The stage GDCk of FIG. 8 has a circuit configuration similar to that of the stage GDk of FIG. 3, or the discharge unit 630 further includes a capacitor C43. A capacitor C41 and the capacitor C43 are serially and sequentially connected between a first node N41 and a voltage terminal V1 receiving a gate-off voltage VOFF.

The capacitor C41 is serially connected to the capacitor C43, and thus, a second node N42 is not floated. However, the capacitance of the capacitor C41 increases compared to the capacitor C1 of FIG. 3, for boosting of the first node N41. In another method, when the parasitic capacitance of a second transistor M42 is designed to satisfy "Cgs<<Cgd", the influence of the coupling voltage that is expressed as the Equation (1) can be minimized.

As described above, when a gate line is driven to a gate-off voltage, a second node connected to a boosting capacitor in a boosting unit is connected to the gate-off voltage according to various embodiments. Thus, a transistor connected to a first node can be prevented from being turned on.

According to the embodiments, the gate driving circuit can perform a stable operation irrespective of an operation environment thereof.

That is, the foregoing embodiments provide for a gate driving circuit with enhanced reliability and a display device including the same.

Exemplary embodiments have been disclosed herein, and although specific terms are employed, they are used and are to be interpreted in a generic and descriptive sense only and not for purpose of limitation.

What is claimed is:

1. A gate driving circuit, comprising:

a pre-charge unit pre-charging a first node in response to a first input signal;

a pull-up unit outputting a first clock signal as a gate driving signal in response to a first node signal of the first node;

a boosting unit boosting the first node signal of the first node in response to the first node signal and the first clock signal, wherein the boosting unit includes a first capacitor connected between the first node and a second node and wherein the first node is directly connected to the first capacitor and the second node is directly connected to the first capacitor; and a discharge unit discharging the first node through the second node to a gate-off voltage level in response to a second input signal and a second clock signal.

2. The gate driving circuit as claimed in claim 1, wherein the pre-charge unit includes a first transistor connected between a first voltage and the first node and controlled by the first input signal.

3. The gate driving circuit as claimed in claim 1, wherein the pull-up unit includes a second transistor connected between the first clock signal and the gate driving signal and controlled by the first node signal of the first node.

4. The gate driving circuit as claimed in claim 1, wherein the boosting unit includes:

a third transistor connected between the first clock signal and the second node and having a gate controlled by the first node signal of the first node.

5. The gate driving circuit as claimed in claim 4, wherein the discharge unit includes a fourth transistor connected between the first node and a second voltage and controlled by a second input signal.

6. The gate driving circuit as claimed in claim 5, wherein the discharge unit includes:

a fifth transistor connected between the second node and a gate-off voltage and having a gate controlled by the second clock signal;

a second capacitor connected between the first clock signal and a third node;

a sixth transistor connected between the second node and the gate-off voltage and having a gate controlled by a third node signal of the third node;

a seventh transistor connected between the first node and the gate-off voltage and having a gate controlled by the third node signal of the third node;

an eighth transistor connected between the third node and the gate-off voltage and having a gate controlled by the first node signal of the first node;

a ninth transistor connected between a gate driving signal and the gate-off voltage and having a gate controlled by the third node signal of the third node; and a tenth transistor connected between the gate driving signal and the gate-off voltage and having a gate controlled by the second clock signal.

7. The gate driving circuit as claimed in claim 5, wherein:

the discharge unit further receives a third clock signal and a fourth clock signal, and the discharge unit includes:

a fifth transistor connected between the second node and a gate-off voltage and having a gate controlled by the fourth clock signal;

a second capacitor connected between the third clock signal and a third node;

a sixth transistor connected between the second node and the gate-off voltage and having a gate controlled by a third node signal of the third node;

a seventh transistor connected between the first node and the gate-off voltage and having a gate controlled by the third node signal of the third node;

an eighth transistor connected between the third node and the gate-off voltage and having a gate controlled by the first node signal of the first node;

a ninth transistor connected between a gate driving signal and the gate-off voltage and having a gate controlled by the third node signal of the third node; and a tenth transistor connected between the gate driving signal and the gate-off voltage and having a gate controlled by the second clock signal.

8. The gate driving circuit as claimed in claim 6, wherein the first clock signal and the second clock signal have a complementary level.

9. The gate driving circuit as claimed in claim 6, further comprising a third capacitor connected between the second node and the gate-off voltage.

10. The gate driving circuit as claimed in claim 6, wherein:

the discharge unit further receives a third clock signal and a fourth clock signal, and the discharge unit includes:

a third capacitor connected between the third clock signal and a fourth node;

an eleventh transistor connected between the fourth node and the gate-off voltage and having a gate controlled by the first node signal of the first node;

a twelfth transistor connected between the fourth node and the gate-off voltage and having a gate controlled by the fourth clock signal; and a thirteenth transistor connected between the second node and the gate-off voltage and having a gate controlled by a fourth node signal of the fourth node.

11. The gate driving circuit as claimed in claim 7, wherein:

frequencies of the first to fourth clock signals are the same, the first clock signal and the second clock signal are complementary signals, the third clock signal and the fourth clock signal are complementary signals, the third clock signal is shifted from a first level to a second level prior to the first clock signal, and the fourth clock signal is shifted from the first level to the second level prior to the second clock signal.

12. The gate driving circuit as claimed in claim 10, wherein:

the first and second clock signals are complementary signals having a same frequency, the third and fourth clock signals are complementary signals having a same frequency, the frequency of the third and fourth clock signals is twice as fast as that of the first and second clock signals, and the third clock signal has a second level when the first and second clock signals have a first level.

13. A display device, comprising:

a plurality of stages which are dependently connected, wherein each of the stages includes:

a pre-charge unit pre-charging a first node in response to a first input signal;

a pull-up unit outputting a first clock signal as a gate driving signal in response to a first node signal of the first node;

a boosting unit boosting the first node signal of the first node in response to the first node signal and the first clock signal, wherein the boosting unit includes a first capacitor connected between the first node and a second node and wherein the first node is directly connected to the first capacitor and the second node is directly connected to the first capacitor; and a discharge unit discharging the first node through the second node to a gate-off voltage level in response to a second input signal and a second clock signal.

14. The display device as claimed in claim 13, further comprising:

a timing controller generating the first and second clock signals; and a voltage generator generating a gate-off voltage.

15. The display device as claimed in claim 14, wherein the pre-charge unit includes a first transistor connected between a first voltage and the first node and controlled by the first input signal.

16. The display device as claimed in claim 15, wherein the pull-up unit includes a second transistor connected between the first clock signal and the gate driving signal and controlled by the first node signal of the first node.

17. The display device as claimed in claim 16, wherein the boosting unit includes:

a third transistor connected between the first clock signal and the second node and having a gate controlled by the first node signal of the first node.

18. The display device as claimed in claim 17, wherein the discharge unit includes a fourth transistor connected between the first node and a second voltage and controlled by a second input signal.

19. The display device as claimed in claim 18, wherein the voltage generator further generates the first and second voltages.

* * * * *